US009422790B2

(12) United States Patent
Williamson

(10) Patent No.: US 9,422,790 B2
(45) Date of Patent: Aug. 23, 2016

(54) SAFETY VALVE WITH LOCKOUT CAPABILITY AND METHODS OF USE

(75) Inventor: Jimmie Robert Williamson, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/407,083

(22) PCT Filed: Aug. 29, 2012

(86) PCT No.: PCT/US2012/052740

§ 371 (c)(1),
(2), (4) Date: Dec. 11, 2014

(87) PCT Pub. No.: WO2014/035384

PCT Pub. Date: Mar. 6, 2014

(65) Prior Publication Data

US 2015/0184488 A1 Jul. 2, 2015

(51) Int. Cl.

| | |
|---|---|
| ***E21B 34/10*** | (2006.01) |
| ***E21B 34/12*** | (2006.01) |
| ***E21B 34/14*** | (2006.01) |
| *E21B 34/00* | (2006.01) |

(52) U.S. Cl.

CPC ..... *E21B 34/101* (2013.01); *E21B 34/102* (2013.01); *E21B 34/12* (2013.01); *E21B 34/14* (2013.01); *E21B 2034/005* (2013.01)

(58) Field of Classification Search

None

See application file for complete search history.

(56) References Cited

U.S. PATENT DOCUMENTS

| | | | | |
|---|---|---|---|---|
| 3,786,865 | A | 1/1974 | Tausch et al. | |
| 3,786,866 | A | 1/1974 | Tausch et al. | |
| 4,356,867 | A | 11/1982 | Carmody | |
| 4,411,316 | A | 10/1983 | Carmody | |
| 4,597,446 | A | 7/1986 | Helderle | |
| 4,624,315 | A | 11/1986 | Dickson et al. | |
| 4,723,606 | A | 2/1988 | Vinzant et al. | |
| 4,967,845 | A | 11/1990 | Shirk | |
| 5,127,476 | A | 7/1992 | Dickson et al. | |
| 5,167,284 | A * | 12/1992 | Leismer | E21B 34/102 166/323 |
| 5,249,630 | A | 10/1993 | Meaders et al. | |
| 5,597,016 | A | 1/1997 | Manke et al. | |
| 5,636,661 | A | 6/1997 | Moyes | |
| 6,059,041 | A | 5/2000 | Scott | |
| 6,575,249 | B2 | 6/2003 | Deaton | |

(Continued)

FOREIGN PATENT DOCUMENTS

WO 2014035384 A1 3/2014

OTHER PUBLICATIONS

International Search Report and Written Opinion for PCT/US2012/052740 dated May 16, 2013.

*Primary Examiner* — Jennifer H Gay
*Assistant Examiner* — Caroline Butcher
(74) *Attorney, Agent, or Firm* — McDermott Will & Emery LLP; Scott Richardson

(57) ABSTRACT

A safety valve includes a housing, a flapper coupled to the housing and movable between open and closed positions, and a flow tube movably disposed within the housing to retain the flapper in the open position. A lockout rod is coupled to the housing and movable between deployed and stored positions. The lockout rod is configured to retain the flow tube in an extended position when in the deployed position. A lockout ratchet element is arranged within the housing and coupled to the lockout rod. The lockout ratchet element is configured to retain the lockout rod in the deployed position.

13 Claims, 9 Drawing Sheets

(56) References Cited

U.S. PATENT DOCUMENTS

| | | | |
|---|---|---|---|
| 6,684,958 | B2 | 2/2004 | Williams et al. |
| 6,902,006 | B2 | 6/2005 | Myerley et al. |
| 7,137,452 | B2 | 11/2006 | McVicker |
| 7,926,575 | B2 | 4/2011 | Ringgenberg et al. |
| 2004/0007365 | A1 | 1/2004 | Hill et al. |
| 2008/0196891 | A1 | 8/2008 | Mailand et al. |
| 2010/0200245 | A1 | 8/2010 | Ringgenberg et al. |

* cited by examiner

SAFETY VALVE WITH LOCKOUT CAPABILITY AND METHODS OF USE

BACKGROUND

The present invention relates generally to operations performed and equipment utilized in conjunction with a subterranean well and, in particular, to a safety valve with a built-in lockout feature.

Subsurface safety valves are well known in the oil and gas industry and act as a failsafe to prevent the uncontrolled release of reservoir fluids in the event of a worst-case scenario surface disaster. Typical subsurface safety valves are flapper-type valves which are opened and closed with the help of a flow tube moving telescopically within the production tubular. The flow tube is often controlled hydraulically from the surface and is forced into its open position using a piston and rod assembly that may be hydraulically charged via a control line linked directly to a hydraulic manifold or control panel at the well surface. When sufficient hydraulic pressure is conveyed to the subsurface safety valve via the control line, the piston and rod assembly forces the flow tube downward, which compresses a spring and simultaneously pushes the flapper downward to the open position. When the hydraulic pressure is removed from the control line, the spring pushes the flow tube back up, which allows the flapper to move into its closed position.

Some safety valves are arranged thousands of feet underground and are therefore required to traverse thousands of feet of borehole, including any turns and/or twists formed therein, before arriving at its proper destination. Consequently, during its descent downhole, the control line may undergo a substantial amount of vibration or otherwise sustain significant damage thereto. In extreme cases, the control line may be severed or one of the connection points for the control line may become inadvertently detached either at a surface well head or at the safety valve itself, thereby rendering the safety valve powerless. Moreover, during prolonged operation in downhole environments that exhibit extreme pressures and/or temperatures, the hydraulic actuating mechanisms used to move the flow tube may fail due to mechanical failures such as seal wear or the like. As a result, some safety valves prematurely fail, thereby leading end users to request the ability to lock the damaged safety valve in the open position.

SUMMARY OF THE INVENTION

The present invention relates generally to operations performed and equipment utilized in conjunction with a subterranean well and, in particular, to a safety valve with a built-in lockout feature.

In at least one aspect, the disclosure provides a safety valve including a housing, a flapper coupled to the housing and being movable between an open position and a closed position, a flow tube movably disposed within the housing and having an extended position, the flow tube being configured to retain the flapper in the open position when in the extended position, a lockout rod coupled to the housing and being movable between a deployed position and a stored position, the lockout rod being configured to retain the flow tube in the extended position when the lockout rod is in the deployed position, and a lockout ratchet element arranged within the housing and coupled to the lockout rod, the lockout ratchet element being configured to retain the lockout rod in the deployed position.

In other aspects, the disclosure may provide a method of locking open a safety valve. The method may include moving a flapper of the safety valve to an open position, extending a flow tube of the safety valve to an extended position, wherein the flow tube is configured to retain the flapper in the open position when the flow tube is in the extended position, deploying a lockout rod of the safety valve to a deployed position, the lockout rod being configured to retain the flow tube in the extended position when the lockout rod is in the deployed position, and retaining the lockout rod in the deployed position with a lockout ratchet element arranged within the housing and coupled to the lockout rod.

In yet other aspects, the disclosure may provide a lockout tool including a top tube having an upper bore, an intermediate ring coupled to the top tube, wherein the top tube and the intermediate ring are configured to selectably block a longitudinal flow path of a housing of a safety valve when the lockout tool is disposed within the safety valve, the safety valve having a longitudinal up-down axis, and an exercise key coupled to the intermediate ring and configured to selectably engage keying features of a flow tube of the safety valve.

The features and advantages of the present invention will be readily apparent to those skilled in the art upon a reading of the description of the preferred embodiments that follows.

BRIEF DESCRIPTION OF THE DRAWINGS

The following figures are included to illustrate certain aspects of the present invention, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

Figure 1:
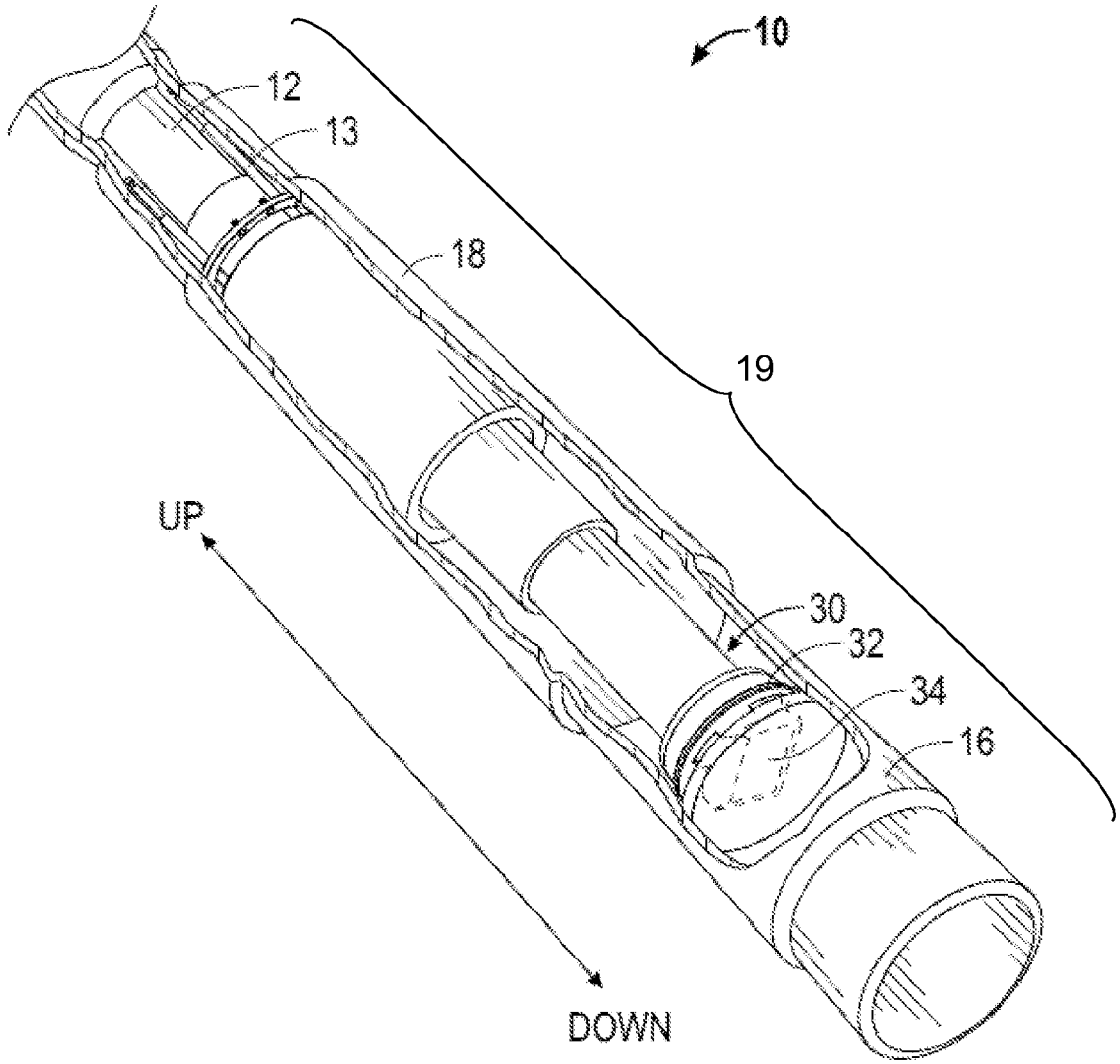
FIG. 1 depicts an example safety valve with a valve assembly that includes a flapper and a valve seat, according to one or more embodiments.

The present invention relates generally to operations performed and equipment utilized in conjunction with a subterranean well and, in particular, to a safety valve with a built-in lockout feature.

The exemplary safety valves disclosed herein provide a downhole safety valve that incorporates a feature that, when used in conjunction with a lock-out tool as disclosed herein, permanently locks the safety valve in an open position. At least one advantage of the safety valves disclosed herein is that inclusion of a lockout capability requires only a minimal increase in the cost of the safety valve. Moreover, conventional safety valves can easily be retrofitted or otherwise modified with the embodiments disclosed herein. Another advantage is that the exemplary lockout tool described herein is a robust design that can be stored on-site for an extended period of time without a significant risk of degradation in operability. As can be appreciated, this decreases the operational time required to correct a failed safety valve.

As used herein, the term "pressure seal" is used to indicate a seal which provides pressure isolation between members which have relative displacement therebetween, for example, a seal which seals against a displacing surface, or a seal carried on one member and sealing against the other member, etc. A pressure seal may be elastomeric or resilient, nonelastomeric, metal, composite, rubber, or made of any other material. A pressure seal may be attached to each of the relatively displacing members, such as a bellows or a flexible membrane. A pressure seal may be attached to neither of the relatively displacing members, such as a floating piston.

In the following description of the representative embodiments of the disclosure, directional terms such as "above," "below," "upper," "lower," etc., are used for convenience in referring to the accompanying drawings. In general, "above," "upper," "upward" and similar terms refer to a direction toward the earth's surface along a wellbore, and "below," "lower," "downward" and similar terms refer to a direction away from the earth's surface along the wellbore.

Within this document, the phrase "flow tube" means an element that is extended to open or maintain in an open position a safety valve, such as a flapper valve. Elements with this function are sometimes referred to as a "control sleeve." An alternate embodiment of a safety valve may utilize a different type of element to hold the flapper open.

Within this document, the term "lock open" or similar means that a movable device having an open position has been retained in or near the open position by a modification to the movable device or placement of a secondary device, such as a flow tube, so as to prevent the movable device from a large departure from the open position. The movable device may be allowed to move some distance from the open position, for example 10% of the motion required to move from the open position to a closed position, that is considered sufficiently similar to the open position of the movable device.

The safety valve 10 and/or lockout tool 300, as described herein below, may include numerous seals to provide pressure-sealing capability between separate parts, fittings and fasteners to join separate parts, and multiple components that are manufactured separately, for example, for ease of manufacture, and assembled to provide certain elements of the safety valve 10 and/or lockout tool 300. Within this document and the associated drawings, multiple components may be provided with a single reference identifier to indicate that the components are considered as a single functional element although, in certain embodiments, they may be fabricated as separate parts and assembled. In addition, the materials from which the various components of the safety valve 10 and/or lockout tool 300 are fabricated are selected based on the function, design, and service environment. The details of these types of features are known to those of skill in the art and are not described herein so as not to obscure the disclosure.

FIG. 1 depicts an example safety valve 10 with a valve assembly 30 that includes a flapper 34 and a valve seat 32, according to one or more embodiments. The safety valve 10 may be used in an offshore oil and gas application, a land-based oil and gas rig, or a rig located at any other geographical site. It should be understood that the disclosure is not limited to any particular type of well.

The valve assembly 30 is located within a housing 19 that includes an upper sub 18 and a lower sub 16. The safety valve 10 has a longitudinal up-down axis, as shown in FIG. 1, and the upper end of the upper sub 18 is configured to sealingly mate with production tubing 12 through which the oil and/or gas flows out of the well. One or more control lines 13 run parallel to the production tubing 12 and connect to a fitting 18A (not shown in FIG. 1). As discussed in more detail below, the one or more control lines 13 may be configured to actuate the safety valve 10, for example, to maintain the safety valve 10 in an open position, or otherwise to close the safety valve 10 and thereby prevent a blowout in the event of an emergency.

In some embodiments, the one or more control lines 13 may be hydraulic conduits that provide hydraulic fluid pressure to the safety valve 10. In operation, hydraulic fluid may be conveyed or otherwise applied to one or more of the control lines 13 from a hydraulic manifold (not shown) arranged at a remote location, such as at a production platform or a subsea control station. When properly applied, the hydraulic pressure derived from one or more of the control lines 13 may be configured to open and maintain the safety valve 10 in its open position, thereby allowing production fluids to flow through the tubing string. To move the safety valve 10 from its open position and into a closed position, the hydraulic pressure in the one or more control lines 13 may be reduced or otherwise eliminated.

While only one control line 13 is depicted in FIG. 1, it should be understood that more than one control line 13 may be employed without departing from the scope of the disclosure. It should also be understood that other means, besides hydraulic fluid pressure, may be used to actuate the safety valve 10, in keeping with the principles of the disclosure. For example, the safety valve 10 could be at least partially electrically actuated, in which case the control line 13 could be an electrical or a fiber optic line that communicates with a servo or other subsea motor or actuator. In other embodiments, the safety valve 10 could be actuated using telemetry, such as mud pulse, acoustic, electromagnetic, seismic or any other type of telemetry. In yet other embodiments, the safety valve 10 could be actuated using any type of surface or downhole power source communicably coupled to the safety valve 10 via one or more control lines 13.

Moreover, although the control line 13 is depicted in FIG. 1 as being arranged external to the production tubing 12, it will be readily appreciated by those skilled in the art that any hydraulic line may be used to convey actuation pressure to the safety valve 10. For example, the hydraulic line could be internal to the production tubing 12, or formed in a sidewall of the production tubing 12. The hydraulic line could extend from a remote location, such as from the earth's surface, or another location in the wellbore (not shown in FIG. 1). In yet other embodiments, the actuation pressure could be generated by a pump or other pressure generation device communicably coupled to the safety valve 10 via the control line 13.

Figure 2:
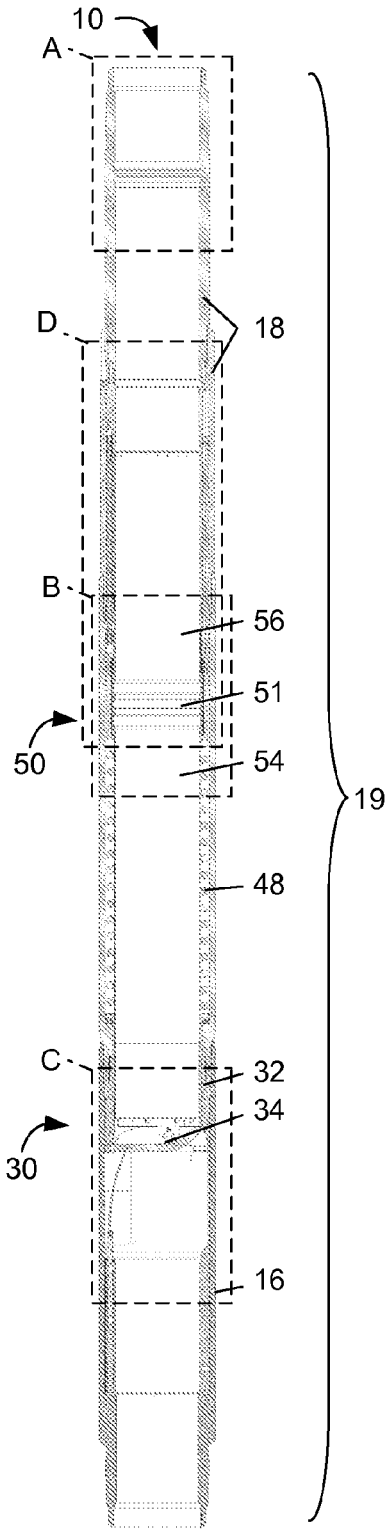
FIG. 2 and the enlarged cross-sectional views in FIGS. 2A-2F are cross-sectional views of an exemplary safety valve, according to one or more embodiments.

FIG. 2 and the enlarged views in FIGS. 2A-2E are cross-sectional views of an exemplary safety valve 10, according to one or more embodiments. The safety valve 10 has a housing 19, which includes a top sub 18 and a bottom sub 16, and a valve assembly 30 having a flapper 34 and a valve seat 32. The safety valve 10 also includes a flow tube 50 disposed within the housing 19, the flow tube 50 having a center element 51, a lower flow tube 54, and an upper flow tube 56. A closure spring 48 is disposed within the housing 19 and serves to bias the center element 51 upward.

Figure 2A:
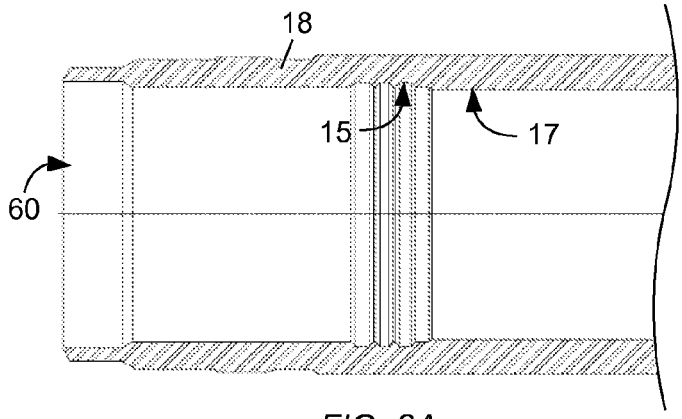

FIG. 2A is a cross-section of the portion of safety valve 10 indicated by the dashed-line box A in FIG. 2. FIG. 2A depicts the upper end of the top sub 18 where a no-go profile 15 is provided on the interior surface of an internal flow path 60 defined within the safety valve 10, according to certain aspects of the present disclosure. In some embodiments, the profile 15 is a proprietary RPT® no-go profile commercially available through Halliburton Energy Services of Houston, Tex., USA. Below the no-go profile 15 is a honed bore 17 that is controlled in diameter and surface finish so as to provide a suitable surface for engagement of sealing features of various tools, such as the exemplary lockout tool 300 disclosed herein below.

Figure 2B:
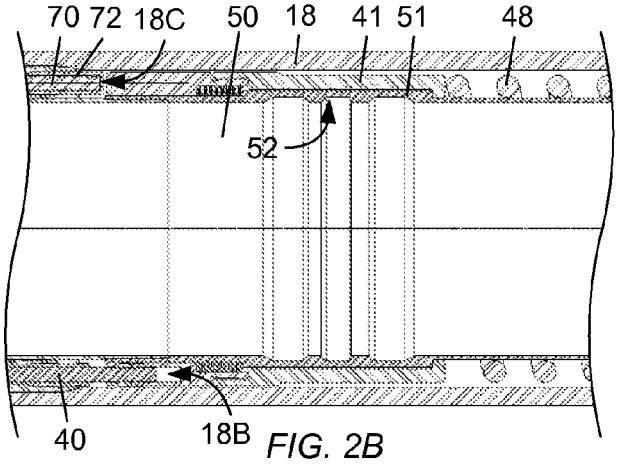

FIG. 2B is a cross-section of the portion of safety valve 10 indicated by the dashed-line box B in FIG. 2. FIG. 2B depicts a forcing ring 41 that may be disposed within the top sub 18 axially adjacent the closure spring 48 which pushes upward on the forcing ring 41, according to certain aspects of the present disclosure. An actuation rod 40 is shown at the bottom, in the view of FIG. 2B, and is disposed in a drilled passage 18B fluidly connected to a control line port 18A (shown in FIG. 2D). A lockout rod 70 is shown at the top, in the view of FIG. 2B, and is disposed in a drilled passage 18C. The lockout rod 70 is discussed in greater detail below with respect to FIG. 2E. Both the actuation rod 40 and the lockout rod 70 are configured to push downward on the forcing ring 41, according to certain aspects of the present disclosure. The center element 51 is configured to engage the forcing ring 41 such that a downward force may be applied by the flow tube 50 to the forcing ring 41 via the center element 51. The actuation rod 40 and the closure spring 48 engage opposite sides of the forcing ring 41. Providing hydraulic pressure to the control line 13 (FIG. 1) will force the actuation rod 40 downward, thereby forcing the forcing ring 41 and the flow tube 50 downward. In contrast, releasing the pressure in the control line 13 will allow the closure spring 48 to force the forcing ring 41 and flow tube 50 back upward. One or more keying features 52 may be defined on the inner surface of the center element 51.

Figure 2C:
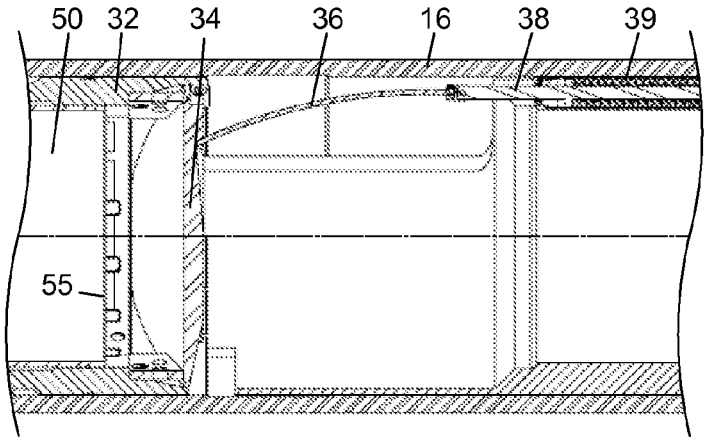

FIG. 2C is a cross-section of the portion of safety valve 10 indicated by the dashed-line box C in FIG. 2. FIG. 2C depicts the flapper 34 in the closed position against the valve seat 32, according to certain aspects of the present disclosure. A flapper arm 36 may be in contact with the underside of the flapper 34 and also in contact with a flapper piston 38 that may be configured to engage a flapper spring 39. Once the flow tube 50 is retracted, as generally described above, the combined action of the flapper arm 36, flapper piston 38, and flapper spring 39 may result in urging the flapper 34 towards the closed position, and thereby ceasing fluid flow through the internal flow path 60 (FIG. 2A). The lower edge 55 of the flow tube 50 is visible at the left of FIG. 2C, with the flow tube 50 shown in the retracted position.

Figure 2D:
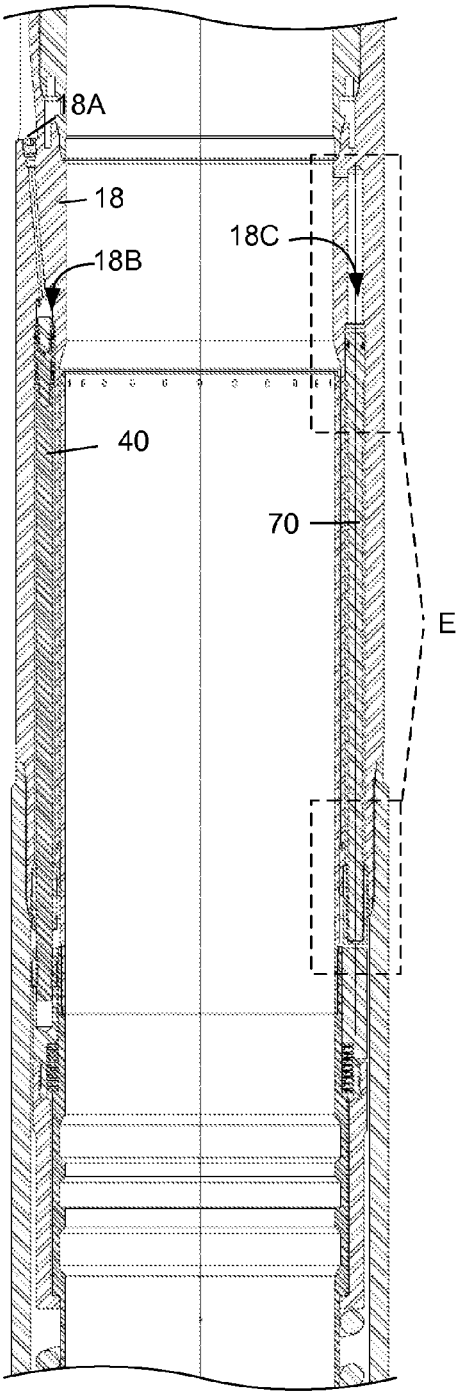

FIG. 2D is a cross-section of the portion of safety valve 10 indicated by the dashed-line box D in FIG. 2. FIG. 2D depicts the actuation rod 40 disposed in the drilled passage 18B and the lockout rod 70 disposed in the drilled passage 18C, according to certain aspects of the present disclosure. As depicted, the drilled passage 18B may be in fluid communication with the control line port 18A. The details of drilled passage 18C are discussed in greater detail below with respect to FIG. 2E.

Figure 2E:
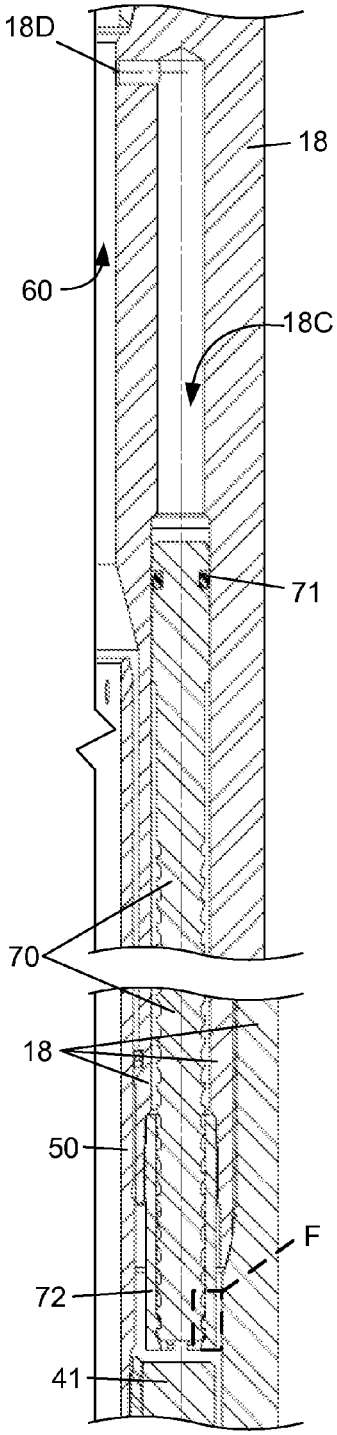

FIG. 2E is a cross-section of the portion of safety valve 10 indicated by the dashed-line boxes jointly marked E in FIG. 2D. FIG. 2E depicts the upper end and lower end of the lockout rod 70 disposed within the drilled passage 18C in the top sub 18, according to certain aspects of the present disclosure. The drilled passage 18C is fluidically coupled to the flow path 60 of the safety valve 10 through a lockout activation port 18D defined in the inner wall of the flow path 60 just above the flow tube 50 when in the retracted position. There is a pressure seal 71 near the top of the lockout rod 70 that seals the gap between the lockout rod 70 and the walls of the drilled passage 18C such that pressure in the drilled passage 18C above the lockout rod will force the lockout rod 70 downward. The lockout rod 70 has at least one shaped ridge 74, and in certain embodiments, has a series of shaped ridges 74 arranged along the lockout rod 70. The shaped ridges 74 are discussed in greater detail below with respect to FIG. 2F.

At the bottom of the drilled passage 18C is a lockout ratchet element 72 disposed about the lower end of the lockout rod 70. In certain embodiments, the lower end of the drilled passage 18C is enlarged to accommodate the lockout ratchet element 72, thereby preventing the lockout ratchet element 72 from moving upward within the drill passage 18C. The lockout rod 70 is shown in FIG. 2E in its stored, i.e. most upward, configuration. When the lockout rod 70 is forced downward, i.e. moved to its deployed position, the lockout rod 70 passes through the lockout ratchet element 72. The interaction of the lockout rod 70 and the lockout ratchet element 72 is discussed below in greater detail with respect to FIG. 2F.

Figure 2F:
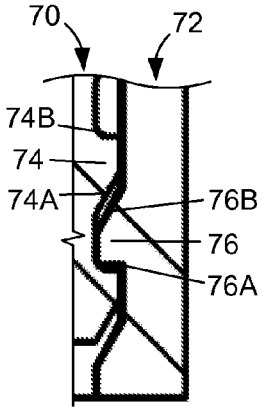

FIG. 2F is a cross-section of the portion of safety valve 10 indicated by the dashed-line box F in FIG. 2E. FIG. 2F depicts the exemplary shaped ridges 74 of the lockout rod 70 and the exemplary retention features 76 of the lockout ratchet element 72, according to certain aspects of the present disclosure. In one or more embodiments, the lockout rod 70 may have at least one shaped ridge 74 and the lockout ratchet element 72 may have at least one corresponding retention feature 76 configured to engage the at least one shaped ridge 74 as the lockout rod 70 moves from its stored configuration to its deployed configuration. In one or more embodiments, the at least one shaped ridge 74 and the at least one retention feature 76 may be configured to allow the at least one shaped ridge 74 to move past the at least one retention feature 76 in a first direction but prevent the at least one shaped ridge 74 from moving past the at least one retention feature 76 in a second direction that is opposite the first direction. In one or more embodiments, each shaped ridge 74 may have a lower sloped face 74A and an upper flat face 74B. Each retention feature 76 may have a lower flat face 76A and an upper sloped face 76B. In one or more embodiments, the slope of the lower sloped face 74A may be generally the same as the slope of the upper sloped face 76B. In one or more embodiments, the angles of the lower flat face 74B and the upper flat face 76B may be generally perpendicular to an axis of motion of the lockout rod 70. In one or more embodiments, the angles of the lower flat face 74B and the upper flat face 76B may be complementary and undercut at complementary angles (not shown in FIG. 2F).

The lockout ratchet element 72 may be configured such that the sides may flex to allow the shaped ridges 74 to pass between the retention features 76 as the lockout rod 70 is forced downward, with the sloped faces 74A and 76A cooperating to allow the downward movement of the lockout rod 70 with respect to the lockout ratchet element 72. Once the shaped ridges 74 have passed by the respective retention features 76, the sides may then spring back toward the center. As a result, upward movement of the lockout rod 70 with respect to the lockout ratchet element 72 may be inhibited, and in certain embodiments prevented, by the interaction of the flat faces 74B and 76B. If the forcing ring 41 is moved to its lowest position, corresponding the flow tube 50 being fully extended and flapper 34 held open, the lockout rod 70 may be forced to a fully deployed position wherein the lower end of the lockout rod 70 is in contact with the forcing ring 41. Once the lockout rod 70 is in this fully deployed position, the one or more retention features 76, and in particular the flat faces 76B, may interact with the one or more shaped ridges 74, and in particular the flat faces 74B, so as to prevent upward motion of the lockout rod 70, thereby locking the flapper 43 in the open position.

Figures 3, 4, 5:
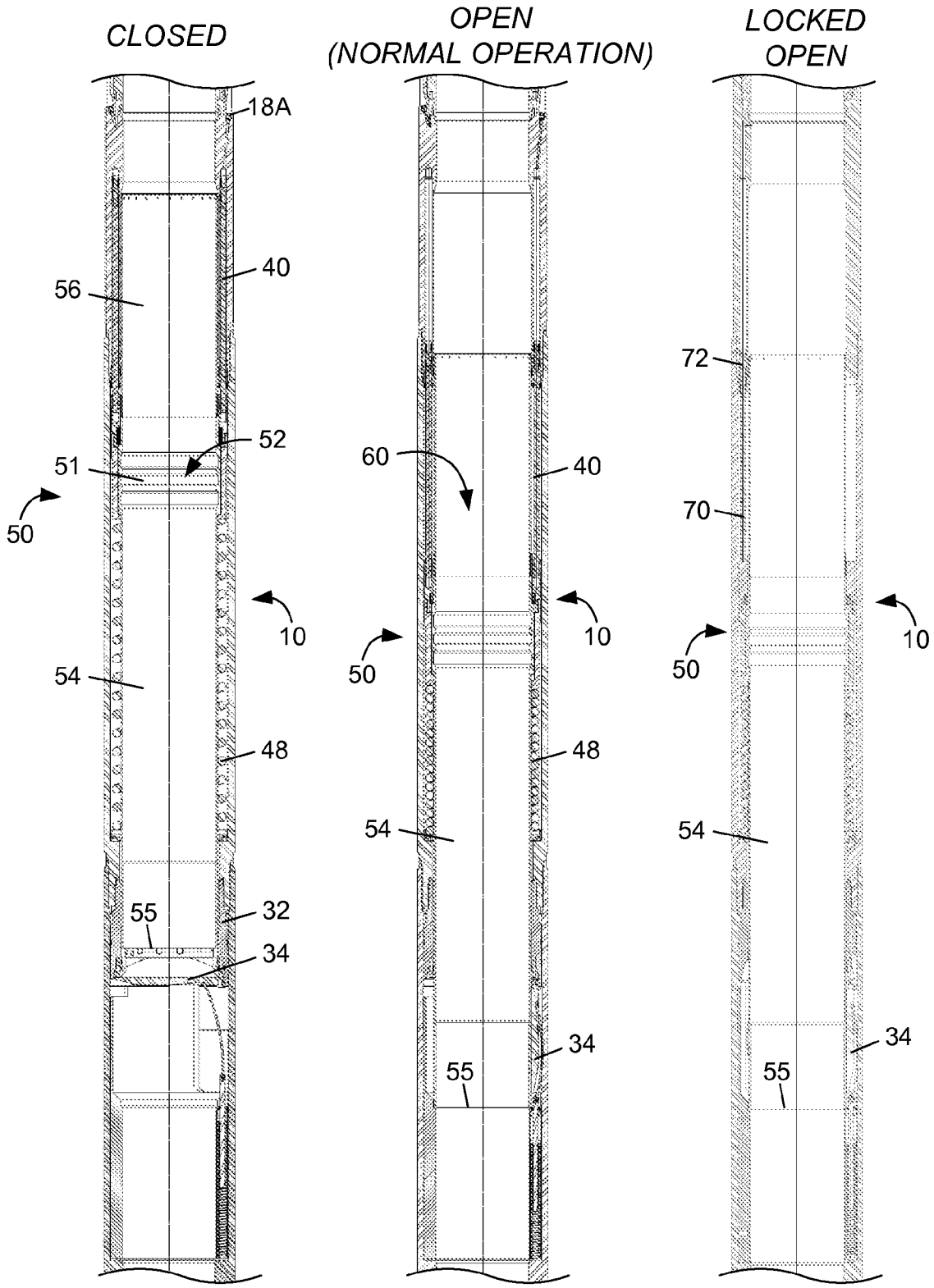
FIG. 3 is a partial cross-sectional view of the safety valve in the closed position, according to one or more embodiments.
FIG. 4 is a partial cross-sectional view of the safety valve in the open position during normal operation of the safety valve, according to one or more embodiments.
FIG. 5 is a partial cross-sectional view of the safety valve in the locked-open position after completion of a lock-out operation using a lockout tool as disclosed herein, according to one or more embodiments.

FIG. 3 is a partial cross-sectional view of the safety valve 10 in the closed position, according to certain aspects of the present disclosure. As illustrated, the closure spring 48 is in its extended (e.g., expanded) position, forcing the flow tube 50 upward to its retracted position, thereby allowing the flapper 34 to move to its closed position against valve seat 32, thereby preventing upward flow through the safety valve 10.

FIG. 4 is a partial cross-sectional view of the safety valve 10 in the open position during normal operation of the safety valve 10, according to certain aspects of the present disclosure. As illustrated, the flow tube 50 is in its fully extended position, wherein the lower edge 55 has extended past and below the flapper 34, thereby forcing the flapper 34 open and maintaining the flapper 34 in its open position. The flow tube 50 in its extended position also protects the flapper 34 from accumulating debris within the oil and/or gas flowing through the flow path 60 of the safety valve 10. As briefly described above, the closure spring 48 is compressed by downward motion of actuation rod 40 under pressure provided through the control line 13 (FIG. 1) and is shown in its compressed configuration.

FIG. 5 is a partial cross-sectional view of the safety valve 10 in the locked-open position after completion of a lockout operation using the lockout tool 300 described below with reference to FIG. 6, according to certain aspects of the present disclosure. The fully deployed lockout rod 70 maintains the flow tube 50 in at least a partially extended position with lower edge 55 proximate to the flapper 34, as shown in this example, that is sufficient that the lower flow tube 54 maintains the flapper 34 in the open position. As the lockout rod 70 cannot move upward, being restrained by the lockout ratchet element 72 (FIG. 2E), the safety valve 10 is permanently disabled with the flapper 34 locked in the open position.

Figure 6:
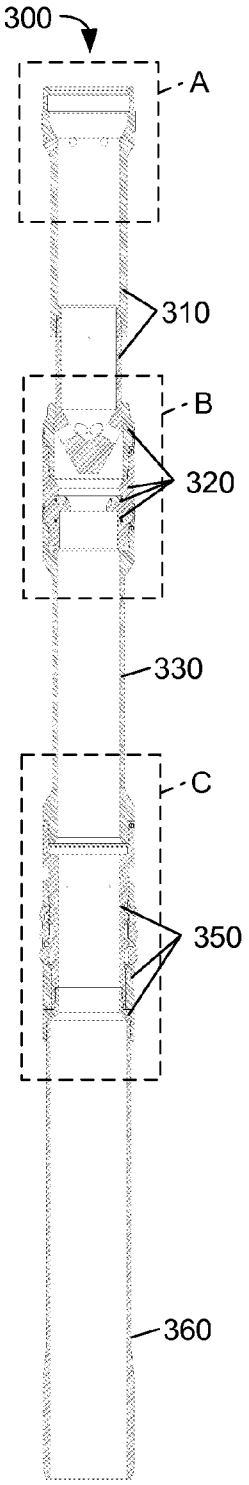
FIG. 6 and the enlarged cross-sectional views in FIGS. 6A-6C illustrate an exemplary lockout tool, according to one or more embodiments.
Figure 6A:
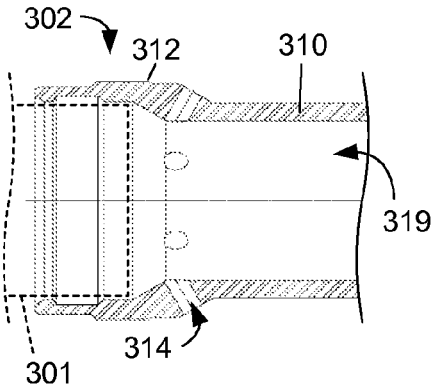
Figure 6B:
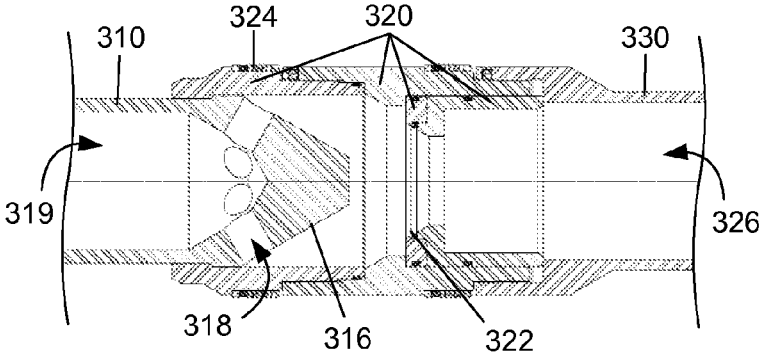
Figure 6C:
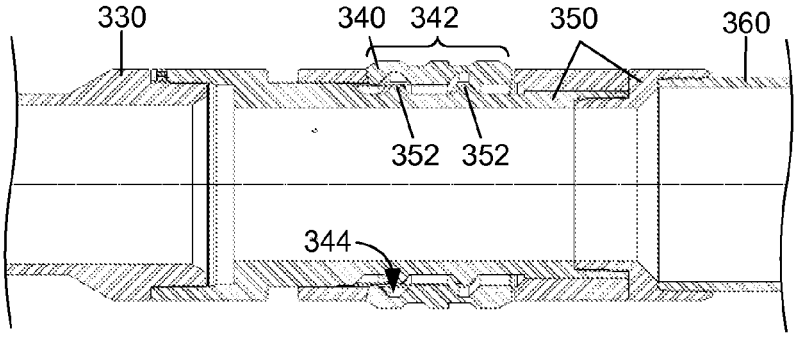

FIG. 6 and the enlarged views in FIGS. 6A-6C illustrate an exemplary lockout tool 300, according to one or more embodiments. FIG. 6 depicts the entire lockout tool 300, which includes a top tube 310, an intermediate ring 320, a middle tube 330, a key expander mandrel 350, and an opening prong 360. Some of these elements may be formed, in certain embodiments, of multiple parts that are joined, for example by threaded couplings, to form a functional element. The embodiment shown in FIG. 6 is only one example and the lockout tool 300 may be formed, in certain embodiments, from a single element or multiple alternate elements different from those shown herein.

FIG. 6A is a cross-section of the portion of lockout tool 300 indicated by the dashed-line box A in FIG. 6. FIG. 6A depicts a fishing neck 302 formed at the top end of the top tube 310. An upper bore 319 passes through the top tube 310 with flow passages 314 defined in a wall of the top tube 310. A no-go stop 312 is formed as part of the exterior features of the fishing neck 302 and is discussed in greater detail with respect to FIG. 9A. The fishing neck 302 is configured to engage the lower end of a pulling tool 301, shown in phantom in FIG. 6A, that can be used to lower the lockout tool 300 into, or remove the lockout tool 300 from, the safety valve 10. Upward and downward forces can be applied to the lockout tool 300 through the pulling tool 301 to "jar up" or "jar down" the lockout tool.

FIG. 6B is a cross-section of the portion of lockout tool 300 indicated by the dashed-line box B in FIG. 6. FIG. 6B depicts an enlarged view of the intermediate ring 320 that is, at least in this embodiment, formed from four pieces that are fixedly joined (e.g., assembled) together. A pressure seal 324 is provided on an outside surface of the intermediate ring 320 and configured to sealingly mate with the honed bore 17 (FIG. 2A) of the safety valve 10. The lower end of the top tube 310 is slidingly captured within the intermediate ring 320 and is shown in an upwardmost position, wherein an upward force on the top tube 310 will transfer the upward force to the intermediate ring 320.

The lower end of the top tube 310 may have a tapered nose seal surface 316 that sealingly mates with a pressure seal 322 of the intermediate ring 320 when the top tube 310 is moved downward with respect to the intermediate ring 320. The top tube 320 may also define one or more flow passages 318 such that fluid can pass down the upper bore 319 defined within the top tube 320, through the various flow passages 318, and down through the lower bore 326 defined within the middle tube 330 when the nose seal surface 316 is not mated with the pressure seal 322. When the lockout tool 300 is engaged in the safety valve 10 with the pressure seal 324 engaged with the honed bore 17 (FIG. 2A) of the safety valve 10, the only longitudinal flow path through the housing 19 passes from the upper bore 319 of the top tube 310 through the intermediate ring 320 and into the lower bore 326 of the middle tube 330. This flow path is blocked when the top tube 310 is moved downward with respect to the intermediate ring 320 into a downward position wherein the nose seal surface 316 is mated with the pressure seal 322 (FIG. 8A).

FIG. 6C is a cross-section of the portion of lockout tool 300 indicated by the dashed-line box C in FIG. 6. FIG. 6C depicts an enlarged view of the key expander mandrel 350 that is, at least in this embodiment, formed of two pieces that are fixedly coupled or otherwise assembled together. The middle tube 330 and the opening prong 360 are fixedly coupled to top and bottom ends, respectively, of the key expander mandrel 350. An exercise key 340 is disposed around the key expander mandrel 350. The key expander mandrel 350 includes, in this example, two key expander ridges 352 on an exterior surface of the key expander mandrel 350 wherein the key expander ridges 352 are positioned in the configuration of FIG. 6C under two relief clearances 344 on an interior surface of the exercise key 240, wherein the relief clearances 344 have similar profiles to the key expander ridges 252 such that the key expander ridges 352 and the relief clearances are not in contact. The exercise key 340 can slide with respect to the key expander mandrel 350 and can be expanded or otherwise flexed outward upon application of a radial outward force. The exercise key 340 also includes a set of keying features 342 on an external surface. The function of the keying features 342 is discussed in greater detail with respect to FIG. 8B below.

Figure 7:
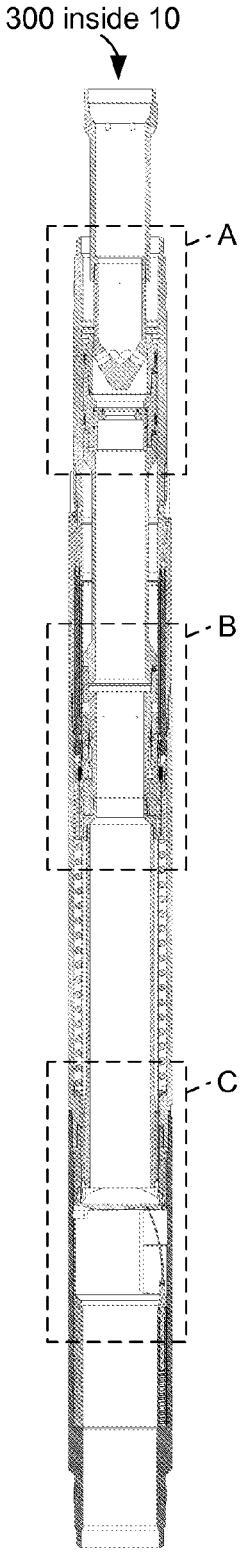
FIG. 7 and the enlarged cross-sectional views in FIGS. 7A-7C show the exemplary lockout tool disposed in the safety valve and configured for a first step in the lock-out operation, according to one or more embodiments.
Figure 7A:
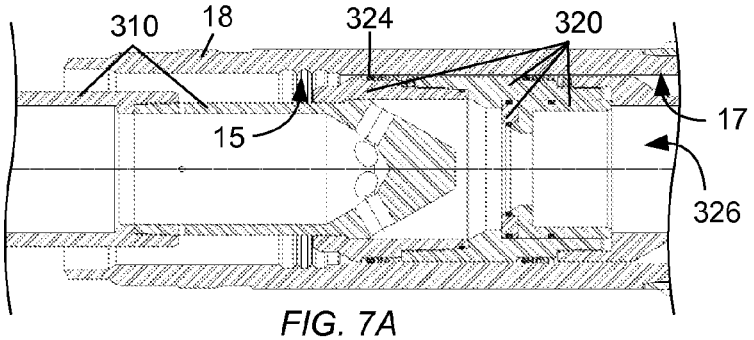
Figure 7B:
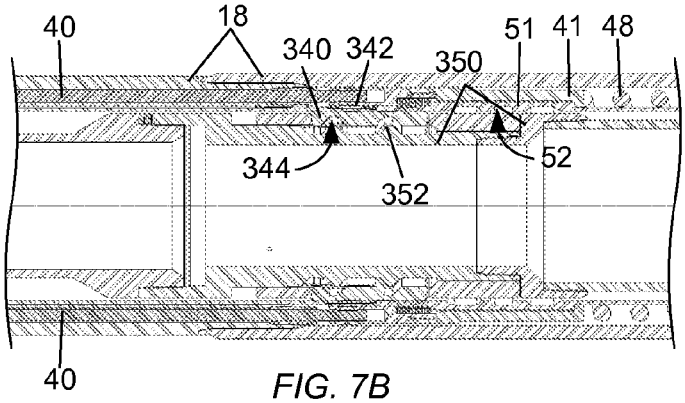
Figure 7C:
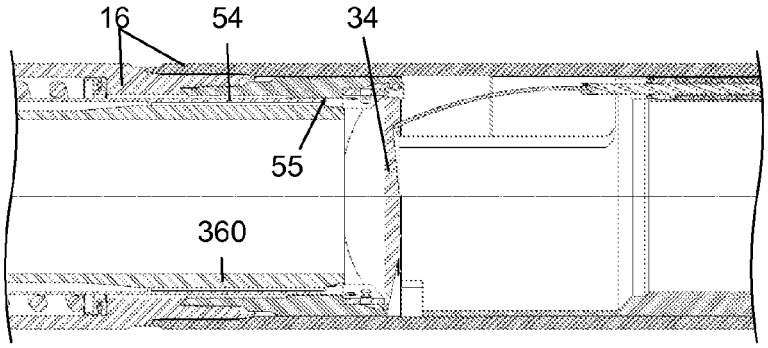

FIG. 7 and the enlarged views in FIGS. 7A-7C show the exemplary lockout tool 300 disposed in the safety valve 10 and configured for a first step in the lock-out operation, according to one or more embodiments. In the configuration of FIG. 7, the lockout tool 300 has been lowered into the safety valve 10 until the bottom of the opening prong 360 is generally in contact with the closed flapper 34.

FIG. 7A is a cross-section of the portion of lockout tool 300 indicated by the dashed-line box A in FIG. 7. FIG. 7A depicts an enlarged view of the intermediate ring 320 with the pressure seal 324 engaged with the honed bore 17 of the upper sub 18 below the no-go profile 15. The top tube 310 is shown in an uppermost position with respect to the intermediate ring 320. With the pressure seal 324 engaged, the only flow path from the production tubing 12 down to the flapper 34 (not shown in FIG. 6A) is through the lower bore 326. When the top tube 310 is in the uppermost position, or in a lower position wherein the nose seal surface 316 is not mated with the pressure seal 322, the flow path from the production tubing 12 to the lower bore 326 is open.

FIG. 7B is a cross-section of the portion of lockout tool 300 indicated by the dashed-line box B in FIG. 7. FIG. 7B depicts an enlarged view of the key expander mandrel 350 and the exercise key 340 disposed proximate to the forcing ring 41. The relief clearances 344 of the exercise key 340 are still aligned with the key expander ridges 352 of the key expander mandrel 350 and the keying features 342 are offset from the keying features 52 of the center element 51 of the safety valve 10. The closure spring 48 is visible at the right, or downstream, side of FIG. 7B in the expanded position and the actuation rods 40 are visible at the left, or upstream, side of the upper sub 18.

FIG. 7C is a cross-section of the portion of lockout tool 300 indicated by the dashed-line box C in FIG. 7. FIG. 7C depicts an enlarged view of the area around the flapper 34. The lower flow tube 54 is shown within the bottom sub 16 with the lower edge 55 above the flapper 34. The opening prong 360 is disposed within the lower flow tube 54 and generally in contact with the hemispherical portion of the flapper 34, which is in the closed position.

Figure 8:
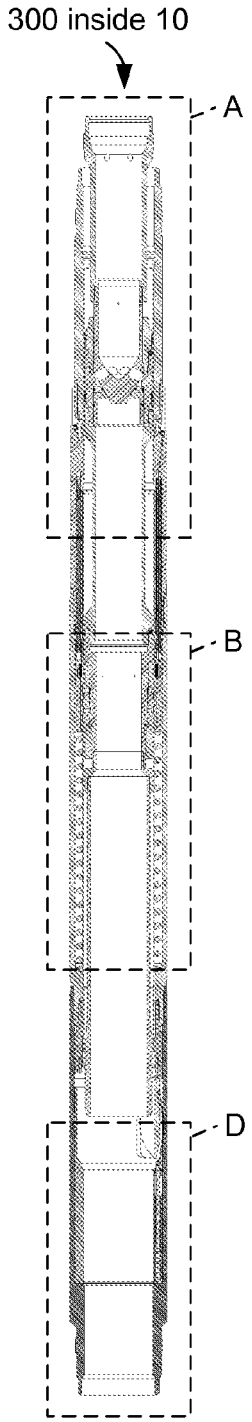
FIG. 8 and the enlarged cross-sectional views in FIGS. 8A-8C show the exemplary lockout tool disposed in the safety valve and configured for a second step in the lock-out operation, according to one or more embodiments.
Figure 8A:
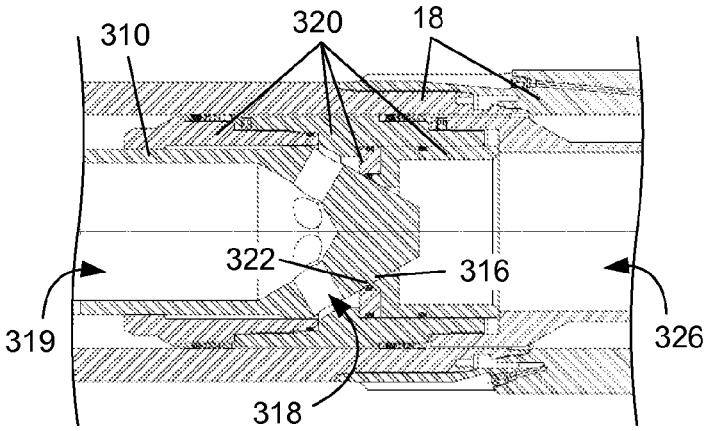
Figure 8B:
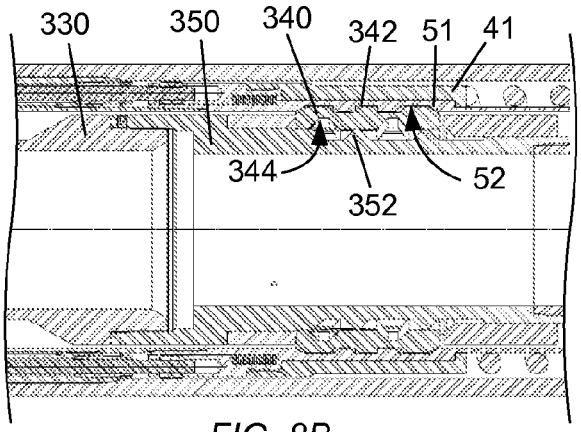
Figure 8C:
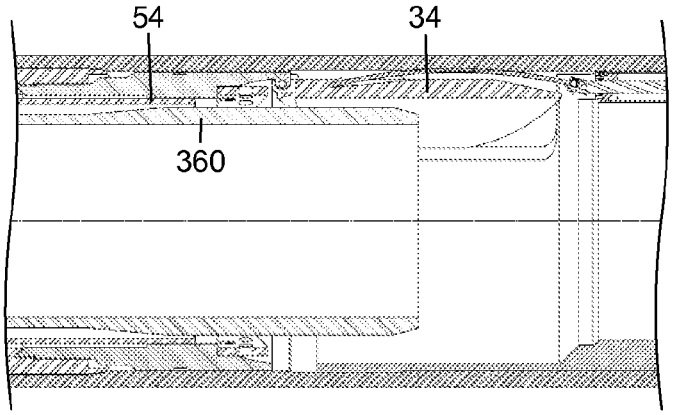

FIG. 8 and the enlarged views in FIGS. 8A-8C show the exemplary lockout tool 300 disposed in the safety valve 10 and configured for a second step in the lock-out operation, according to one or more embodiments. While in the configuration of FIG. 7, wherein there is a flow path from the production tubing 12 to the flapper 34, the pressure within the safety valve 10 above the flapper 34 may be increased to be approximately balanced with the pressure below the flapper 34. The lockout tool 300 may then be lowered, through one or more of the weight of the lockout tool 300, jarring down the top tube 310 until the nose seal surface 316 is mated with the pressure seal 322, after which further jarring down will cause the entire lockout tool 300 to move downward, and the application of additional pressure in the production tubing 12 after the nose seal surface 316 is mated with the pressure seal 322. Any of these techniques applies a downward force to the entire lockout tool 300, thereby forcing the opening prong 360 to push the flapper 34 to the open position.

FIG. 8A is a cross-section of the portion of lockout tool 300 indicated by the dashed-line box A in FIG. 8. FIG. 8A depicts an enlarged view of the intermediate ring 320 showing how the top tube 310 has moved downward with respect to the intermediate ring 320 until the nose seal surface 316 is mated with the pressure seal 322, thereby blocking the flow path from the upper bore 319 through the flow passages 318 to the lower bore 326. If the pressure in the upper bore 319 is greater than the pressure in the lower bore 326, a downward force may be applied to the intermediate ring 320, thereby forcing it downward within the upper sub 18.

FIG. 8B is a cross-section of the portion of lockout tool 300 indicated by the dashed-line box B in FIG. 8. FIG. 8B depicts the key expander ridges 352 being displaced downward from the relief clearances 344 of the exercise key 340 so as to force the exercise key 340 to expand radially outward from a retracted position to an expanded position. The keying features 342 of the exercise key 340 are shown engaged with the keying features 52 of the center element 51. Note that the keying features 342 and 52 are configured such that the keying features 342 will move downward over the keying features 52 until the respective features 342, 52 are aligned, whereupon further downward motion of the exercise key 340 relative to the center element 51 is prevented by engagement of the keying features 342 and 52. Once the lockout tool 300 is in the configuration shown in FIGS. 8-8C, additional downward force applied to the top tube 310 is transferred through the middle tube 330 to the key expander mandrel 350 and then through the exercise key 340 to the center element 51 that in turn transfers the downward force to the forcing ring 41.

FIG. 8C is a cross-section of the portion of lockout tool 300 indicated by the dashed-line box C in FIG. 8. FIG. 8C illustrates that the opening prong 360 has moved the flapper 34 to the open position as the opening prong 360 descended past the flapper 34 while the lower flow tube 54 remains in the most upward, i.e. the retracted position.

Figure 9:
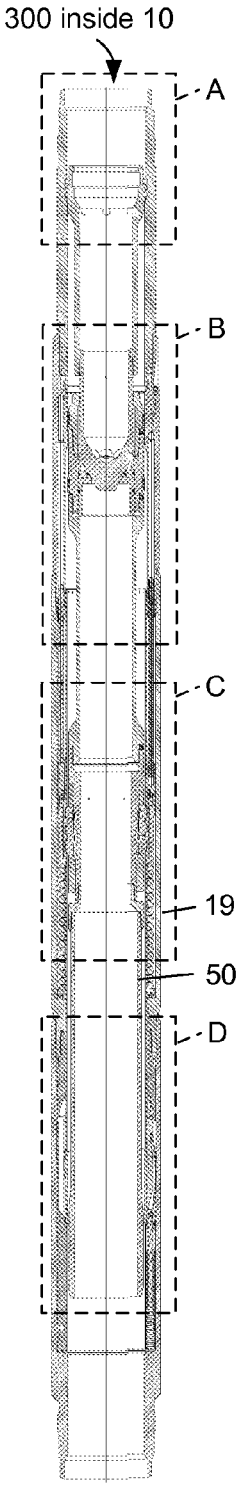
FIG. 9 and the enlarged cross-sectional views in FIGS. 9A-9D show the exemplary lockout tool disposed in the safety valve and configured for a third step in the lock-out operation, according to one or more embodiments.

FIG. 9 and the enlarged views in FIGS. 9A-9D show the exemplary lockout tool 300 disposed in the safety valve 10 and configured for a third step in the lock-out operation, according to one or more embodiments. The flow tube 50 has been moved downward within the housing 19, e.g. by jarring down, until the flow tube 50 is in its lowest, i.e. extended, position.

Figure 9A:
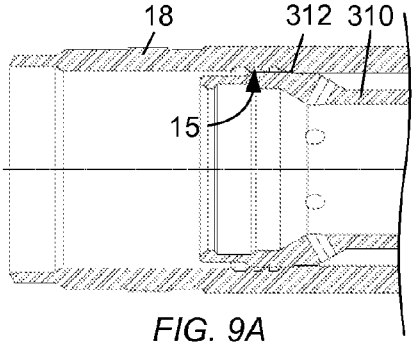

FIG. 9A is a cross-section of the portion of lockout tool 300 indicated by the dashed-line box A in FIG. 9. FIG. 9A illustrates that the no-go stop 312 of the top tube 310 of the lockout tool 300 is in contact with the no-go profile 15 of the upper sub 18 of the safety valve 10 at a downwardmost position of the top tube 310 within the safety valve 10. While the ability of the top tube 310 to move relative to the intermediate ring 320 may allow a lower portion of the lockout tool 300 (i.e. the intermediate ring 320, the middle tube 330, the exercise key 340, the key expander mandrel 350, and the opening prong 360) to move further downward within the safety valve 10, the engagement of the exercise key 340 with the forcing ring 41 may prevent this further downward motion when the closure spring 48 is fully compressed. The lockout tool 30 is configured to prevent damage to the safety valve 10 from further downward motion of any portion of the lockout tool 300 within the safety valve 10 once the no-go stop 312 engages the no-go profile 15.

Figure 9B:
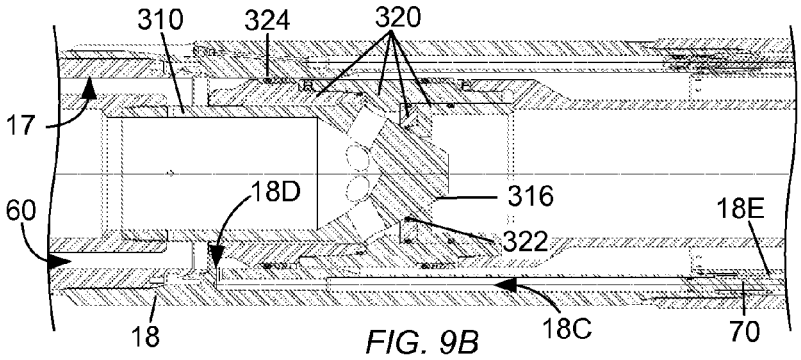

FIG. 9B is a cross-section of the portion of lockout tool 300 indicated by the dashed-line box B in FIG. 9. FIG. 9B shows the position of the intermediate ring 320 within the safety valve 10 after the flow tube 50 has been moved to its extended position such that the lockout rod 70 can be deployed. The pressure seal 324 is engaged with the honed bore 17 of the housing 18 and the nose seal surface 316 of the top tube 310 is mated with the pressure seal 322 of the intermediate ring 320, thereby blocking the flow path 60 at a point between the lockout activation port 18D and the bottom 18E of the drilled passage 18C. In this position and configuration of the lockout tool 300, there can be a pressure differential between the lockout activation port 18D and the bottom 18E of the drilled passage 18C. Provision of an activation pressure in the production tubing 12 when the lockout tool 300 is configured as shown in FIG. 9 will cause such a pressure differential, which will apply a net downward force on the lockout rod 70 and move the lockout rod 70 from its stored position to the deployed position. FIG. 9B depicts the lockout rod 70 in the deployed position. In certain circumstances, the pressure in the safety valve 10 below the intermediate ring 320 may increase when the flow path 60 is blocked at a point between the lockout activation port 18D and the bottom 18E of the drilled passage 18C. The activation pressure in the production tubing may be selected to create a first pressure at the lockout activation port 18D that is greater than a second pressure that is present at the bottom 18E of the drilled passage 18C when the flow path 60 is blocked at a point between the lockout activation port 18D and the bottom 18E of the drilled passage 18C.

Figure 9C:
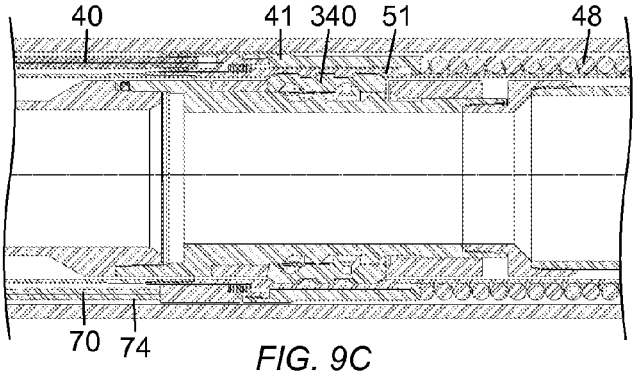

FIG. 9C is a cross-section of the portion of lockout tool 300 indicated by the dashed-line box C in FIG. 9. FIG. 9C shows how the forcing ring 41 has been moved to its lowest position, thereby compressing the closure spring 48, by forces applied through the exercise key 340 and center element 51. The actuation rod 40 is shown in the extended, i.e. most downward, position that opens the flapper 34 (not shown in FIG. 9C) in normal operation. The lockout rod 70 is also shown in its deployed, i.e. most downward, position upon provision of pressure in the production tubing 12 that, with reference to FIG. 2E, entered through port 18D into the drilled passage 18C and force the lockout rod 70 downward. The shaped ridges 74 of the lockout rod 70 are engaged with the retention features 76 of the lockout ratchet element 72 (not shown in FIG. 9C) such that the lockout rod 70 cannot be retracted once it is in its deployed position.

Figure 9D:
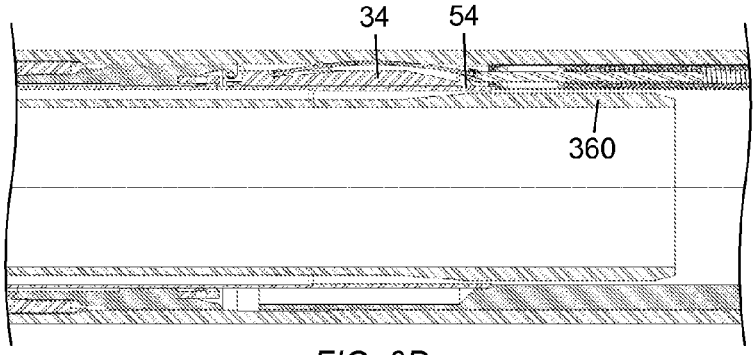

FIG. 9D is a cross-section of the portion of lockout tool 300 indicated by the dashed-line box D in FIG. 9. FIG. 9D shows how the lower flow tube 54 has been extended around the outside of the opening prong 360 and past the flapper 34.

Figure 10:
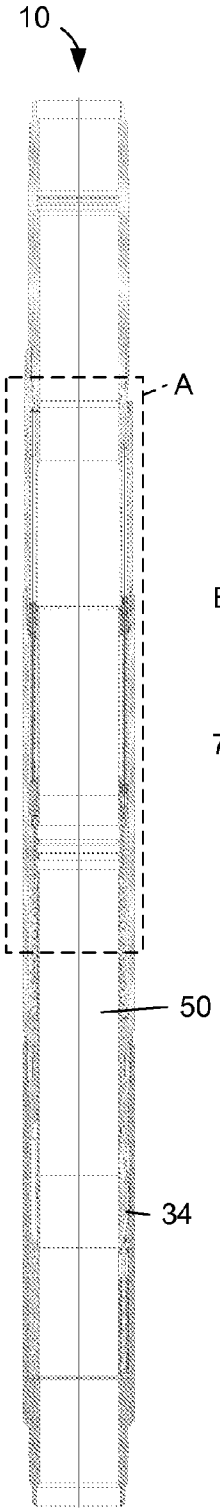
FIG. 10 and the enlarged cross-sectional views
Figure 10A:
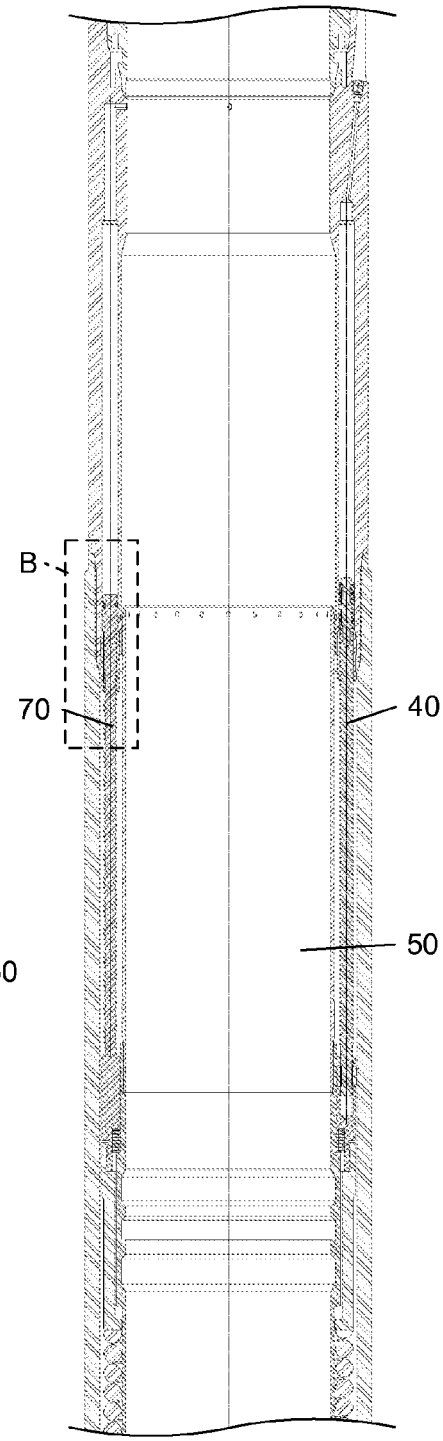
FIGS. 10A-10B illustrate the configuration of the safety valve after successful completion of a lockout operation, according to one or more embodiments.
Figure 10B:
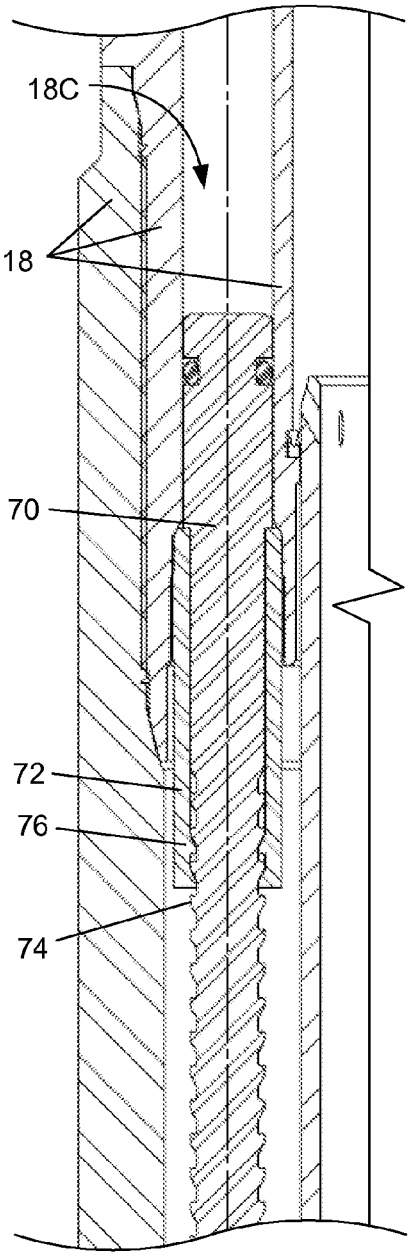

FIG. 10 and the enlarged cross-sectional views FIGS. 10A-10B illustrate the configuration of the safety valve 10 after successful completion of a lockout operation, according to one or more embodiments. The flow tube 50 is in its fully extended, i.e., most downward, position thereby holding the flapper 34 in its open position.

FIG. 10A is a cross-section of the portion of safety valve 10 indicated by the dashed-line box A in FIG. 10. FIG. 10A shows the flow tube 50 with the actuation rod 40 and the lockout rod 70 fully deployed.

FIG. 10B is a cross-section of the portion of safety valve 10 indicated by the dashed-line box B in FIG. 10A. FIG. 10B shows the top of the lockout rod 70 within the drilled passage 18C in the upper sub 18. The upper shaped ridges 74 are engaged with the retention features 76 of the lockout ratchet element 72, thereby preventing the lockout rod 70 from retracting.

Those skilled in the art will readily recognize the several possible configurations for proper actuation and operation of the exemplary safety valve 10 configured with a lockout capability, as generally disclosed herein. For example, the drilled passage 18C of the lockout rod 70 may be connected to a separate lockout control line (not shown), rather than communicating to the production tubing 12, such that the lockout rod 70 is deployed by provision of pressure in the separate lockout control line. As an additional example, the lockout system may include a secondary mechanism (not shown) configured to prevent deployment of the lockout rod 70 until pressure is provided through a secondary lockout control line to release the secondary mechanism. Other variations and combinations will be apparent to those skilled in the art.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

The invention claimed is:

1. A safety valve, comprising:

a housing defining an internal flow path;

a flapper coupled to the housing and movable between an open position and a closed position;

a flow tube movably disposed within the internal flow path between an extended position, where the flow tube retains the flapper in the open position, and a retracted position, where the flapper is able to pivot to the closed position;

a lockout rod positioned within a drilled passage defined in a wall of the housing and in fluid communication with the internal flow path via a lockout activation port, the lockout rod being movable from a stored position to a deployed position, wherein the flow tube is retained in the extended position when the lockout rod is in the deployed position; and a lockout ratchet element arranged within the drilled passage to allow the lockout rod to move to the deployed position and retain the lockout rod in the deployed position.

2. The safety valve of claim 1, wherein the lockout ratchet element is configured to allow the lockout rod to move from the stored position toward the deployed position but simultaneously prevent the lockout rod from moving back toward the stored position.

3. The safety valve of claim 2, further comprising:

at least one shaped ridge defined on the lockout rod; and at least one retention feature defined on the lockout ratchet element and being configured to engage the at least one shaped ridge when the lockout rod is proximate to the deployed position, wherein the at least one shaped ridge and the at least one retention feature are cooperatively configured to allow the at least one shaped ridge to move past the at least one retention feature in a first direction but prevent the at least one shaped ridge from moving past the at least one retention feature in a second direction opposite the first direction.

4. The safety valve of claim 3, further comprising:

a plurality of shaped ridges defined on the lockout rod; and a plurality of retention features defined on the lockout ratchet element, wherein one or more of the plurality of retention features is engaged with one or more of the plurality of shaped ridges at all positions of the lockout rod between and including the stored and deployed positions.

5. The safety valve of claim 1, wherein the safety valve has a longitudinal up-down axis and is coupled to production tubing in fluid communication with the internal flow path, the safety valve further comprising a top provided in the drilled passage, the top being in fluid communication with the flow path of the housing via one or more lockout activation ports.

6. The safety valve of claim 5, wherein:

the lockout rod has a seal that engages the drilled passage;

the bottom of the drilled passage has a bottom that is open to the internal flow path of the housing; and the lockout rod is configured to move downward within the drilled passage when a first pressure at the top of the drilled passage is greater than a second pressure at the bottom of the drilled passage.

7. The safety valve of claim 6, wherein the housing and the flow tube are configured to accept a lockout tool that is configured to selectably block the internal flow path of the housing at a point between the one or more lockout activation ports and the bottom of the drilled passage.

8. A method of locking open a safety valve, the method comprising:

moving a flapper of the safety valve to an open position, the safety valve including a housing that defines an internal flow path and houses the flapper;

extending a flow tube of the safety valve to an extended position, wherein the flow tube is movably disposed within the housing and retains the flapper in the open position when in the extended position;

applying an activation pressure from the internal flow path to a drilled passage defined in a wall of the housing and in fluid communication with the internal flow path via a lockout activation port;

deploying a lockout rod positioned within the drilled passage from a stored position to a deployed position as acted upon by the activation pressure;

retaining the flow tube in the extended position with the lockout rod in the deployed position; and retaining the lockout rod in the deployed position with a lockout ratchet element arranged within the drilled passage.

9. The method of claim 8, further comprising:

allowing the lockout rod to move from the stored position toward the deployed position with the lockout ratchet element; and preventing the lockout rod from moving back toward the stored position with the lockout ratchet element.

10. The method of claim 9, wherein the lockout rod has at least one shaped ridge, the method further comprising:

engaging the at least one shaped ridge with at least one retention feature defined on the lockout ratchet element when the lockout rod is proximate to the deployed position; and allowing the at least one shaped ridge to move past the at least one retention feature in a first direction but preventing the at least one shaped ridge from moving past the at least one retention feature in a second direction opposite the first direction.

11. The method of claim 10, wherein the lockout rod has a plurality of shaped ridges and the lockout ratchet element has a plurality of retention features, and wherein retaining the lockout rod in the deployed position further comprises engaging at least one of the plurality of shaped ridges with at least one of the plurality of engagement features at all positions of the lockout rod between and including the stored position and the deployed position.

12. The method of claim 8, further comprising:

closing the flapper with a first pressure below the flapper;

inserting a lockout tool into the safety valve, the safety valve having a longitudinal up-down axis;

providing a second pressure in production tubing coupled to the safety valve and in fluid communication with the internal flow passage, the second pressure being equal to or greater than the first pressure;

advancing the lockout tool within the internal flow path until an opening prong of the lockout tool is disposed proximate to the flapper; and wherein extending the flow tube further comprises engaging a keying feature of the flow tube with a keying feature of the lockout tool and applying a downward force to the flow tube through the engaged keying features.

13. The method of claim 12, wherein deploying the lockout rod further comprises:

positioning the lockout tool within the safety valve;

blocking the internal flow path of the safety valve with the lockout tool at a point between the lockout activation port at a top of the drilled passage and a bottom of the drilled passage that is open to the internal flow path; and providing the activation pressure in the production tubing to create a differential pressure between the top and the bottom of the drilled passage.

* * * * *